United States Patent [19]

Opderbeck

[11] 4,310,261

[45] Jan. 12, 1982

[54] CONTROL MECHANISM FOR VIBRATORY ROLLER

[75] Inventor: Rudolph G. Opderbeck, Waukesha, Wis.

[73] Assignee: Wacker Corporation, Milwaukee, Wis.

[21] Appl. No.: 126,560

[22] Filed: Mar. 3, 1980

[51] Int. Cl.[3] ..... E01C 19/38

[52] U.S. Cl. ..... 404/117; 180/20

[58] Field of Search ..... 404/117, 84; 74/471 R, 74/87; 180/20

[56] References Cited

U.S. PATENT DOCUMENTS

| | | | |
|---|---|---|---|
| 3,605,583 | 9/1971 | Keppler | 404/117 |
| 3,703,836 | 11/1972 | Kiser | 404/117 X |
| 3,778,177 | 12/1973 | Haker | 404/117 |
| 3,814,531 | 6/1974 | Carnahan | 404/117 |
| 4,149,253 | 4/1979 | Paar | 404/117 X |
| 4,187,036 | 2/1980 | Haker | 404/117 |

*Primary Examiner*—Nile C. Byers, Jr.
*Attorney, Agent, or Firm*—James E. Nilles

[57] ABSTRACT

Speed and direction of movement of a vibratory roller are controlled by a member which is manually shiftable to a neutral position at which the roller is stopped, through a range of forward positions at one side of neutral, and through a range of rearward positions at the opposite side of neutral. The member actuates a cutout switch that is open only when said member is in neutral, a forward switch that is closed only in the range of forward positions, and a reverse switch that is closed only in the rearward range. A vibratory exciter for the roller operates forwardly when a forward solenoid is energized and reversely when a reverse solenoid is energized. Each solenoid is energized through the contacts of an associated relay, which are closed when the coil of the relay is energized through a circuit comprising, in series, a current source, the cutout switch, and the respective forward or reverse switch for the solenoid. The coil and contacts of each relay are in a self-holding circuit through the cutout switch and bypassing the forward and reverse switches; hence, once energized, a relay coil remains energized until the member is shifted to neutral, even through the forward and reverse switches may open at slow roller speeds.

7 Claims, 3 Drawing Figures

CONTROL MECHANISM FOR VIBRATORY ROLLER

FIELD OF THE INVENTION

This invention relates to control mechanisms for vibratory rollers such as are used for compacting asphalt pavement and the soil of road beds and the like; and the invention is more particularly concerned with a control mechanism whereby operation of the exciter of such a roller is fully and automatically coordinated with movements of the roller in response to the positioning of a single manually shiftable control member.

BACKGROUND OF THE INVENTION

A vibratory roller machine of the type to which this invention relates has a roller drum by which compacting forces are imposed upon a surface traversed by the machine and has an exciter housed in the drum by which rapidly alternating up and down acceleration forces are imposed upon the drum to enhance its compacting effectiveness. The exciter ordinarily comprises a rotating eccentric mass, and its direction of rotation must correspond to the direction in which the roller is moving along the surface.

It is important that the exciter should be stopped at any time that the roller is not moving. If the exciter were allowed to operate with the machine at a standstill, the roller would tend to pound an objectionable groove into the surface on which it was resting; but, more important, the vibration produced by the exciter would ruin the bearings of the eccentric and of the drum by a process called brinelling.

The exciter can comprise a hydraulic motor that is controlled by a three position valve actuated by a pair of solenoids, one of which is energized for forward rotation of the exciter and the other of which is energized for its reverse rotation. When neither solenoid is energized, no pressure fluid flows to the exciter motor and the exciter does not operate.

One familiar type of drive for effecting movement of the whole vibratory roller machine comprises a variable displacement hydraulic pump that can be controlled by a single manually shiftable member such as a lever. In a neutral position of that control member, the pump delivers no pressure fluid output and the machine stands still. If the control member is shifted through a range of forward positions at one side of the neutral position, the pressure fluid output of the pump is such that the machine moves forwardly at a speed which corresponds to the distance by which the member is displaced from the neutral position. In like manner, moving the control member through a range of reverse positions at the opposite side of the neutral position causes the machine to move rearward at a speed corresponding to displacement of the control member from neutral.

Heretofore, vibratory rollers have been equipped with cam switches or the like that were actuated by the control member which governed the direction and speed of the machine. The cam actuated switches were electrically connected with the valve solenoids for the exciter, to control their energization in correspondence with the position of the control member and thus automatically coordinate operation of the vibratory exciter with the movements of the machine. In prior control mechanisms of this type, the cam-actuated switch for each valve solenoid had to be closed as the control member was shifted through a range of adjustments at each side of neutral but had to be open when the lever was in its neutral position. If the exciter was to be stopped only when the machine was at an absolute standstill, the cam-actuated switches had to be very carefully and critically adjusted, and their adjustment had to be maintained at all times, notwithstanding the intense pounding vibration to which the entire machine was subjected during most of the time that it was in operation. Since it was not feasible to establish and maintain such a precise adjustment for each switch, the cam-actuated switches were usually so adjusted as to cause the exciter to be stopped whenever the control number was near its neutral position and in a position at which the machine moved slowly forward or backward, in order to ensure that the exciter would not be operating when the machine was stopped.

Such an arrangement was satisfactory if the machine always operated in open areas where it could move safely at relatively fast speeds.

However, there are situations in which it is desirable to operate a vibratory roller in a confined space or relatively close to an obstruction, or in which, for some other reason, it is desirable to have the exciter in operation while the roller is moving very slowly in its forward or rearward direction. For such situations it should not be necessary to make the critical adjustment of cam-actuated exciter control switches that has heretofore been necessary.

SUMMARY OF THE INVENTION

The general object of the present invention is to provide control mechanism for a vibratory roller of the character described, comprising a single manually shiftable member—which can be a lever or the like—for controlling the direction and speed of movement of the roller, and switches connected with that lever to be actuated thereby, for automatically coordinating operation of the exciter with the roller movement, said control mechanism being so arranged that the exciter operates in the proper direction even when the roller is moving very slowly and that the switches which control operation of the exciter can be quickly and easily adjusted as to their mechanical connections with the control member, and tend to remain in adjustment, because their adjustments are not critical.

Another object of the invention is to provide control mechanism of the character described whereby the engine that powers the roller is prevented from starting at any time that the manually shiftable member which controls the direction and speed of roller motion is out of its neutral position.

It will be apparent that it is another and very important general object of the invention to improve the overall safety of a vibratory roller, both by making starting of its engine impossible when the control member is set for movement of the machine and by providing for substantially slower movement of the machine when its exciter is operating.

In general, the vibratory roller control mechanism of the present invention is conventional insofar as it comprises a member whereby direction and speed of roller movement are controlled and which is manually shiftable to a neutral position at which the roller is stopped and through a range of forward positions at one side of said neutral position and a range of rearward positions at the other side of said neutral position. For coordinating exciter operation with roller movement the control mechanism is conventional in comprising a forward switch actuated by said member and closed only when said member is in its range of forward positions, a reverse switch actuated by said member and closed only when said member is in its range of reverse positions, and electrically operated forward and reverse control devices for the exciter, respectively associated with said forward switch and said reverse switch and selectively energizable to cause the exciter to operate in a forward direction and in a reverse direction, respectively. The control mechanism of the present invention is characterized by: cutout switch means actuated by said member and open only when said member is in its neutral position; a pair of relays, comprising a forward relay associated with said forward switch and said forward control device and a reverse relay associated with said reverse switch and said reverse control device, each of said relays having a coil and a set of contacts which are normally open and which are closed when the coil is energized; first conductor means connecting the coil of each of said relays in a series circuit with a current source, said cutout switch means and the switch associated with the relay, so that the coil of each relay is energized when said member is in the range of positions for closure of its associated switch; second conductor means for connecting each control device in an energizing series circuit with a current source, which energizing circuit comprises the cutout switch means and the set of contacts of the relay associated with the control device and is in bypassing relation to the switch associated with the control device so that the control device remains energized as long as the coil of its associated relay is energized; and third conductor means connecting the set of contacts of each of said relays in a self-holding circuit with the coil of that relay so that, once energized, the coil of a relay remains energized until said member is placed in its neutral position to open the cutout switch means.

In a preferred embodiment of the invention the cutout switch means is arranged to prevent starting of the engine that powers the roller unless the manually shiftable member is in its neutral position, and a manually operable exciter switch is so connected in series with the cutout switch means and the current source that energization of both of said control devices is prevented unless said exciter switch is in its closed condition.

BRIEF DESCRIPTION OF DRAWINGS

In the accompanying drawings, which illustrate what is now regarded as a preferred embodiment of this invention.

DETAILED DESCRIPTION OF PREFERRED EMBODIMENT OF INVENTION

A vibratory roller R equipped with a control system embodying the principles of this invention is conventional in having a hydraulic motor M that is connected with a transaxle T through which power is delivered to the drive wheels W of the roller. Pressure fluid is fed to the drive motor M from a variable displacement pump 5 that is driven by an internal combustion engine E.

Figure 3:
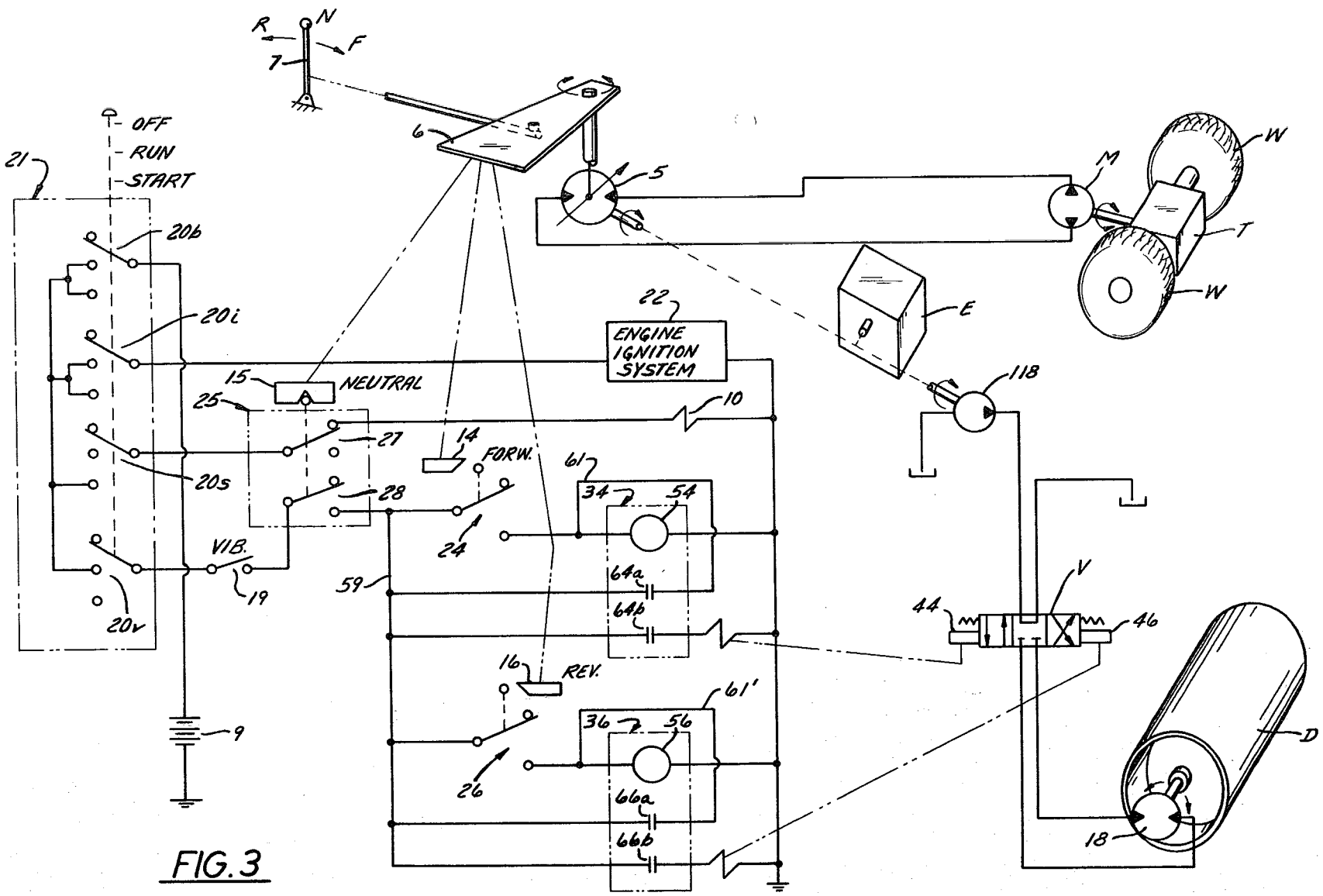
FIG. 3 is a circuit diagram of the control mechanism.

The output of the drive pump 5 is manually controllable by means of a shiftable control member 6 that is connected with an operator's lever 7. When the control member 6 is in a neutral position, as shown in FIG. 3, no pressure fluid is delivered to the drive motor M, and the roller R remains at a standstill. When the control member 6 is shifted through a range of forward positions at one side of its neutral position (to the left of the neutral position in FIG. 3), the motor M receives an output from the pump 5 that causes the roller to move in a forward direction and at a speed which corresponds to the distance by which the control member 6 is displaced from its neutral position. Shifting the control member 6 in the opposite direction from its neutral position (to the right in FIG. 3) carries it through a range of rearward positions in which the roller moves backward at a speed corresponding to the distance by which the control member 6 is displaced from neutral.

The engine E also drives an exciter pump 118 by which pressure fluid is supplied through a three-position directional valve V to the motor 18 of an eccentrically rotating vibratory exciter housed in the drum D of the roller. The exciter motor 18 should run in a direction appropriate to roller motion. When the roller R is stopped, the directional valve V should be in a normal position (as shown) in which no pressure fluid flows through it from the exciter pump 118 to the exciter motor 18, and the latter is stopped. When the roller is moving forward, a forward solenoid 44 that is associated with the exciter valve V should be energized to place that valve in its condition for forward operation of the exciter motor 18; and during rearward roller movement, a reverse solenoid 46 associated with the valve V should be energized to place that valve in its condition for reverse operation of the exciter motor.

The internal combustion engine E that drives the pump 5 also supplies energy for charging a battery 9. For purposes of the explanation, the battery 9 can be regarded as the source of current for electrical equipment that is hereinafter described, including an electric engine starter (not shown) that is energized, as is conventional, through a starter solenoid 10.

Figure 2:
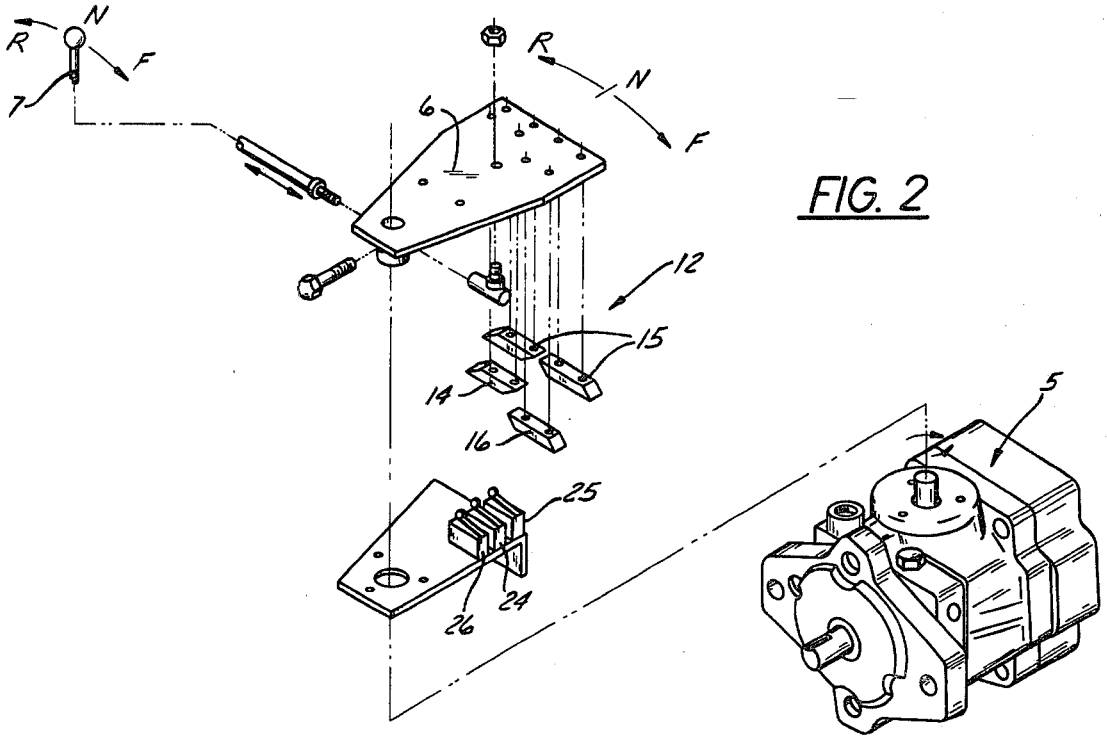
FIG. 2 is an enlarged exploded view of certain mechanical parts of the control mechanism of this invention.
Figure 1:
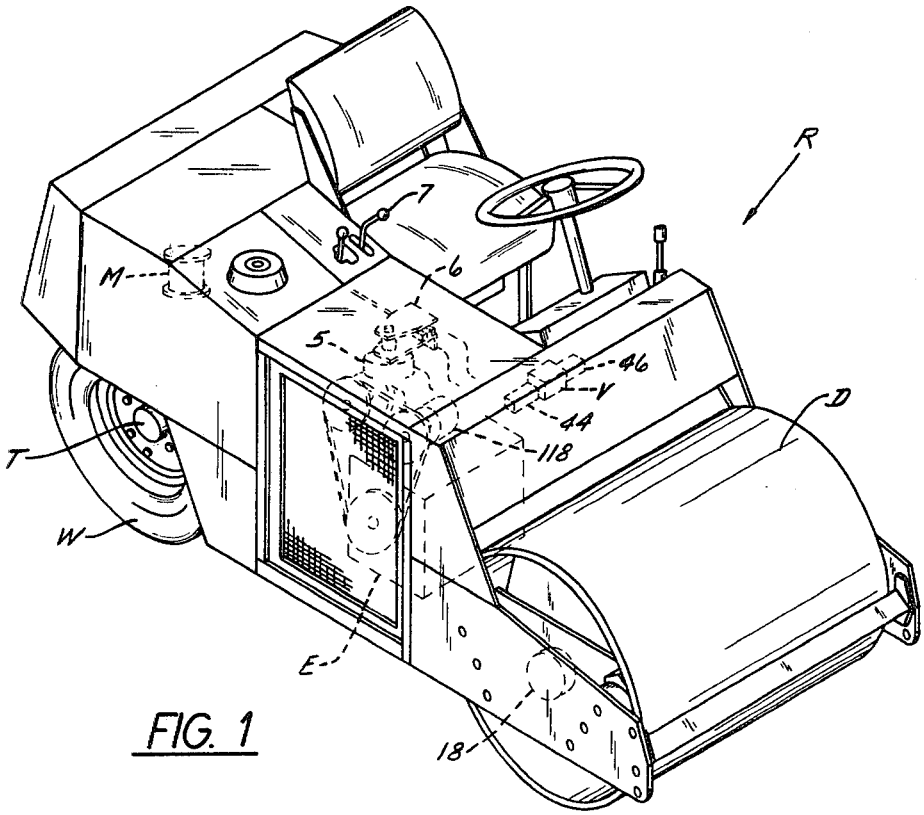
FIG. 1 is a perspective view of a vibratory roller that comprises apparatus embodying the principles of this invention.

The control member 6 carries a cam 12 that comprises three cam elements 14, 15, 16 which respectively cooperate with the actuators for switches 24, 25, 26. Each switch actuator comprises a cam follower, as best seen in FIG. 2. The switch 25, controlled by the cam element 15, comprises cutout switch means having two sets of contacts, namely a set of contacts 27 that is closed only when the control member 6 is in its neutral position and a set of contacts 28 that is open only when the control member is in its neutral position. The switch 24 is a forward exciter switch that is closed only when the control member 6 is within its range of forward positions, and, as explained hereinafter, it is connected with the coil 54 of a forward relay 34 which, in turn, controls the forward solenoid or exciter control device 44. The switch 26, which is a reverse exciter switch that is closely only when the control member 6 is in its range of rearward positions, is similarly connected with the coil 56 of a reverse relay 36 that controls the reverse solenoid or exciter control device 46. Each of the relays 34 and 36 has two sets of contacts 64*a*, 64*b* and 66*a*, 66*b*, respectively, which are both normally open and which are connected as explained hereinafter.

For the exciter motor 18 to operate, the appropriate solenoid 44 or 46 must be energized, as explained above, and, in addition, a manually actuatable vibrator switch 19 must be in its closed condition.

However, even if the vibrator switch 19 is closed when the engine is being started, the vibrator will not operate immediately upon engine starting because the control member 6 must be out of its neutral position for operation of the exciter motor 18 but must be in neutral for energization of the engine starter solenoid 10. Such control of the starter solenoid 10, which prevents possible runaway of the roller R at engine starting, is a function of the contacts 27 of cutout switch 25, which contacts are closed only when the control member 6 is in its neutral position. The energizing circuit for the engine starter solenoid 10 comprises, in series, the battery 9, the "battery" contacts **20*b* of a manually actuated gang switch 21, the "start" contacts 20*s* of said gang switch, and the cutout switch contacts 27. Hence, in order to start the engine E, the gang switch 21 must be placed in its "start" position and the control member 6 must be in its neutral position to close the contacts 27 of the cutout switch means 25. The starter solenoid 10 cannot be energized with the control member 6** in any position in which the roller moves when the engine begins to run.

The engine ignition system, as denoted by 22, is connected in series with the ignition contacts **20*i* of the gang switch 21 but is in parallel with the cutout switch contacts 27 so that, once started, the engine can continue to run in all positions of the control member 6 but can be stopped by placing the gang switch 21 in its "off" position. The vibrator switch 19 is in series with vibrator contacts 20*v* of the gang switch 21** so that current cannot flow to the vibrator switch unless the gang switch is in its "run" position.

When the vibrator switch 19 is closed, neither of the exciter control solenoids 44, 46 can be energized unless the control member 6 is out of its neutral position to close the contacts 28 of the cutout switch means 25. Said contacts 28 are connected in a series circuit between the vibrator switch 19 and the two cam-actuated exciter switches 24 and 26, which are connected in parallel with one another.

The coil 54 of the forward relay is connected with the forward exciter switch 24, to be energized when that cam-actuated switch is closed; and the relay contacts **64*b*, which are closed upon energization of said coil 54, are connected in an energizing circuit for the forward exciter control solenoid 44. In like manner, the coil 56 of the reverse relay is energized upon closure of the cam-actuated reverse exciter switch 26; and the relay contacts 66*b*, which are closed upon energization of coil 56, are connected in an energizing circuit for the reverse exciter control solenoid 46**.

If the engine is running (gang switch 21 in "run" position) and the control member 6 is shifted substantially to the right, out of its neutral position, to start the roller moving forward, the cam 12—and specifically its cam element 15—will bring the cutout switch means 25 to the condition in which its contacts 28 are closed. At the same time, the cam 12—and specifically its cam element 14—will close forward exciter switch 24. Under these conditions the coil 54 of the forward relay 34 will be energized from the battery 9 by way of the series circuit which can be traced through vibrator contacts **20*v* of the gang switch 21, the vibrator switch 19, the now-closed contacts 28 of the cutout switch means 25, and the closed cam-actuated switch 24. With the coil 54 of the forward relay energized, the forward exciter control solenoid 44 is energized through the closed contacts 64*b*, and the exciter motor 18 runs in its forward direction. If the control member 6 were shifted to the left, to cause the machine to move rearward, a similar energizing circuit would be completed for the coil 56 of the reverse relay, through the cam-actuated switch 26; and the reverse exciter control device 46 would be energized through the then-closed contacts 66*b*, causing the exciter motor 18** to run in its reverse direction.

For energizing the respective exciter control devices 44, 46, a conductor 59 leads from the controlled side of the contacts 28 of the cutout switch means 25 and has branches that lead in parallel to the cam-actuated exciter switches 24 and 26 and also to the contacts **64*b* and 66*b* of the respective forward and reverse relays. It can be seen that there is current in the conductor 59 as long as the contacts 28 of the cutout switch means 25 are closed, so that either of the control devices 44 or 46 can be energized so long as its associated relay contacts 64*b* or 66*b* are closed, and even though its associated cam-actuated switch 24 or 26** may be open.

Attention is now directed to a self-holding connection 61 between the contacts **64*a* of the forward relay and the coil 54 of the same relay, and to a similar self-holding connection 61' between the contacts 66*a* and the coil 56 of the reverse relay. Once the coil 54, 56 of either relay has been energized by closure of its associated cam-actuated exciter switch 24, 26, and so long as the control member 6 has not been moved fully back to its neutral position, the contacts 64*a*, 66*a* of that relay will remain closed, and correspondingly the associated control device 44 or 46 will remain energized. This avoids the need for a very careful and precise adjustment of the cam elements 14, 15 and 16 in relation to one another and their respective cam followers. Each of those cam elements is preferably so adjusted that the control member 6 must be moved a little distance into its forward or rearward range before the cam-actuated switch 24 or 26 is closed. This means that when very slow roller movement is desired, and the control member 6 is moved back to a position near its neutral position, but not quite to that position, the cam-actuated switches 24 and 26 will both be open. Nevertheless, under these conditions the exciter motor 18 will continue to operate in the correct direction because the appropriate solenoid 44 or 46 will remain energized, due to the self-holding connection 61 through its associated relay, comprising contacts 64*a* or 66*a***.

However, if the control member 6 is then shifted back fully to the neutral position, opening of the contacts 28 will take current off of the conductor 59, breaking the energizing circuit for the relay coil 54 or 56 and terminating energization of the control device 44 or 46.

It will be seen that, of the three cam elements 14, 15, 16, the only one that comes near to being critical as to its adjustment is the cam element 15 that actuates the cutout switch means 25. However, that cam element 15 is rather quickly and easily adjusted because there is only one well-defined position of the control member 6 (i.e., its neutral position) to which the cutout switch means 25 must respond.

From the foregoing description taken with the accompanying drawings it will be apparent that this invention provides control mechanism for a vibratory roller that comprises a single manually shiftable member for controlling the direction and speed of motion of the roller, whereby the exciter for the roller is always caused to operate in a direction corresponding to the direction of roller movement, even when the roller is moving very slowly, but is nevertheless prevented from operating when the roller is stopped. It will also be apparent that the control mechanism of this invention requires no critical adjustments for its maintenance of automatic control over the exciter under all conditions of roller motion.

What is claimed as the invention is:

1. In a vibratory roller movable in forward and reverse directions and having an exciter for operation only when the roller is moving, said roller further having a control member that is selectively shiftable in opposite directions and being responsive to said control member to move in the direction and at the speed respectively corresponding to direction and extent of displacement of the control member from a defined neutral position thereof at which the roller is stopped, apparatus for controlling said exciter, said apparatus being characterized by:

A. cutout switch means responsive to the position of said control member and arranged to be open only when said control member is in its said neutral position;

B. exciter switch means responsive to the position of said control member and arranged to be closed only when said control member is out of its neutral position;

C. electrically energizable exciter control means connected with said exciter switch means to be energized upon closure thereof and energization of which causes the exciter to operate; and D. electrical circuit holding means having a connection with said cutout switch means and said exciter control means whereby the latter, once energized through the exciter switch means, is maintained energized so long as the cutout switch means is closed and irrespective of the condition of the exciter switch means.

2. The vibratory roller of claim 1 wherein said exciter operates in forward and reverse directions and its direction of operation corresponds to the direction of movement of the roller, further characterized by:

(1) said exciter switch means comprising
  (a) a forward exciter switch that is closed only when said control member is displaced from its neutral position in the direction for forward roller motion, and
  (b) a reverse exciter switch that is closed only when the control member is displaced in the opposite direction from its neutral position;

(2) said exciter control means comprising
  (a) a forward exciter control device which, when energized, causes the exciter to operate in its forward direction, and
  (b) a reverse exciter control device which, when energized, causes the exciter to operate in its reverse direction.

3. The vibratory roller of claim 2 further characterized by:

(1) said electrical circuit holding means comprising a pair of relays, each having
  (a) an electrically energizable coil and
  (b) two sets of normally open contacts which are closed by energization of said coil;

(2) one of said relays being a forward relay and having
  (a) its coil conntected with the cutout switch means and the forward exciter switch, in series,
  (b) one of its sets of contacts connected with the forward exciter control device to control energization thereof, and
  (c) its other set of contacts connected in a series holding circuit with the cutout switch means and its coil; and (3) the other of said relays being a reverse relay and having
  (a) its coil connected with the cutout switch means and the reverse exciter switch, in series,
  (b) one of its sets of contacts connected with the reverse exciter control device to control energization thereof, and
  (c) its other set of contacts connected in a series holding circuit with the cutout switch means and its coil.

4. In a vibratory roller which is movable in forward and rearward directions and which has a control member that is selectively shiftable from a defined neutral position through opposite forward and rearward ranges, said roller being responsive to said control member to move in the direction and at the speed that respectively correspond to direction and extent of displacement of said control member from its said neutral position, said roller also having an exciter operable in forward and reverse directions, control apparatus whereby forward and reverse electrical exciter control devices are selectively energizable to cause said exciter to operate only when the roller is moving and in its direction corresponding to the direction of roller movement, said control apparatus comprising forward and reverse exciter switches which, when closed, respectively provide for energization of said forward and reverse control devices, said exciter switches being so associated with said control member that said forward exciter switch is closed only when said control member is in its forward range and said reverse exciter switch is closed only when said control member is in its rearward range, said control apparatus being characterized by:

A. a cutout switch responsive to the position of said control member to be open only when the control member is in its neutral position;

B. a pair of relays, one for each of said exciter switches and each thus associated with one of said exciter control devices, each relay having
  (1) a coil and
  (2) contacts which are normally open and which are closed when said coil is energized;

C. means connecting the coil of each of said relays in an energizing circuit that comprises, in series,
  (1) the exciter switch for the relay and
  (2) said cutout switch, so that each relay coil is energized when its exciter switch is closed;

D. means connecting the contacts of each relay in an energizing circuit for its associated exciter control device, so that each exciter control device is energized so long as the coil of its associated relay is energized; and E. means connecting the contacts of each relay with its coil in a self-holding energizing circuit that is controlled by said cutout switch, so that, once energized, the coil of a relay remains energized until said control member is moved back to its neutral position, regardless of the conditions of the exciter switches.

5. The vibratory roller of claim 4 wherein said control mechanism is further characterized by:

F. another cutout switch responsive to the position of said control member to be closed only when the control member is in its neutral position, said other cutout switch being connected in a series circuit for controlling energization of an engine starter for the roller so that its engine cannot be started unless said control member is in its neutral position.

6. The vibratory motor of claim 4, further characterized by:

a manually actuated switch connected in said energizing circuit for the coil of each relay, in series with said cutout switch and which can be opened to prevent energization of both of said exciter control devices.

7. Control apparatus for a vibratory roller that comprises an exciter which is to operate only when the roller is moving and in a direction that corresponds to the direction of roller movement, said control apparatus comprising a member whereby direction and speed of roller movement are controlled and which is manually shiftable from a neutral position at which the roller is stopped in opposite directions through a range of forward positions and a range of rearward positions, said control apparatus further comprising a forward exciter control device which must be energized for forward operation of the exciter, a forward exciter switch which is associated with said forward exciter control device and which is closed only when said member is in its range of forward positions, a reverse exciter control device which must be energized for reverse operation of the exciter, and a reverse exciter switch which is associated with said reverse exciter control device and which is closed only when said member is in its range of rearward positions, said control apparatus being characterized by:

A. cutout switch means responsive to the position of said member and arranged to be open only when said member is in its neutral position;

B. a pair of relays, one for each of said forward and reverse exciter control devices, each of said relays comprising (1) a coil, and (2) a set of contacts which are closed when said coil is energized;

C. first conductor means connecting the set of contacts of each relay in a circuit comprising, in series, (1) a current source, and (2) the exciter control device for the relay, whereby each exciter control device is energized so long as the set of contacts of its relay is closed;

D. second conductor means connecting the coil of each relay in a circuit comprising, in series, (1) said current source, (2) said cutout switch means, and (3) the exciter switch associated with the control device for the relay, whereby the coil of each relay is energized by closure of its associated one of said forward and reverse exciter switches; and E. third conductor means connecting the coil of each relay with its set of contacts in a holding circuit that enables the coil of the relay, once energized by closure of its associated one of said exciter switches, to remain energized notwithstanding opening of that switch, so long as said member is not moved to its neutral position.

* * * * *